US006254095B1

(12) United States Patent
Liu

(10) Patent No.: US 6,254,095 B1
(45) Date of Patent: Jul. 3, 2001

(54) TABLE HORSE RACING

(76) Inventor: Bon-Gee Liu, 1236 53A Street, Delta, B.C. (CA), V4M 3E6

( * ) Notice: Subject to any disclaimer, the term of this patent is extended or adjusted under 35 U.S.C. 154(b) by 0 days.

(21) Appl. No.: 09/407,623

(22) Filed: Sep. 28, 1999

(51) Int. Cl.[7] ..... A63F 7/00; A63B 67/00; A63H 11/06

(52) U.S. Cl. ..... 273/108.01; 273/108.55; 273/109; 273/441; 273/461; 446/3

(58) Field of Search ..... 446/3; 273/109, 273/108.55, 108.41, 108.33, 117, 126 R, 287, 108, 108.1, 441, 445, 446, 459, 461

(56) References Cited

U.S. PATENT DOCUMENTS 853,730 * 5/1907 Pearson .
966,761 * 8/1910 Noll .
2,104,314 * 1/1938 Wood .
2,179,084 * 11/1939 Cook .
2,700,251 * 1/1955 Bertaux .
2,973,604 * 3/1961 Digirolamo .
3,653,666 * 4/1972 Barlow .
4,166,620 * 9/1979 Sheppard .

FOREIGN PATENT DOCUMENTS

19431 * 9/1898 (GB) ..... 446/3

* cited by examiner

*Primary Examiner*—Sebastiano Passaniti
(74) *Attorney, Agent, or Firm*—Connolly Bove Lodge & Hutz LLP

(57) ABSTRACT

This invention is about a wood structural tabletop horse racing game. The running of the horses on a board is caused by the back-and-forth shaking movement of the board. The shaking of the board is powered by the turning of a steel nut against an angle plate which pushes the board forward. And the strength of a rubber band in the rear pulls the board back.

1 Claim, 4 Drawing Sheets

TABLE HORSE RACING

BACKGROUND OF THE INVENTION

1. Field of the Invention

The present invention relates to a table horse racing, particularly to a tabletop game of horse racing.

2. Description of Related Art

The horse racing is an exciting outdoor sport, and it also provides fun during being watched. It would be a great challenge if the sport can be brought indoors to provide all the excitement thereof on a tabletop. The present inventor has engaged a long period of experiments and found that a wood board being shaken back and forth smoothly can cause artificial horses of various materials on the board to move in one direction with a slipping fashion. The hammering of the back-and-forth moving board against the rear structure may cause sounds very much like the stamping of the horses. Also, bumps are added on the board to serve as obstacles, making game participants more difficult to guess which horse would come to the finish line first. Those preceding arrangements make the horse racing game on a tabletop enjoyable.

SUMMARY OF THE INVENTION

The table horse racing according to the present invention resides in that a board being pushed forward by turning a nut against an angle plate attached beneath the board and being pulled back by the strength of a rubber band attached to the rear causes back-and-forth shaking movement to make the horses on the board moving in one direction. In addition, the bumps on the board increase the uncertainty about which horse reaches the finish line first. Thus, it makes this toy fun while playing.

An object of the present invention is to provide a table horse racing, which is possible for people to enjoy horse racing indoors.

Another object of the present invention is to provide a table horse racing, which offers fun much like the actual outdoor game of horse racing.

BRIEF DESCRIPTION OF THE DRAWINGS

The present invention can be more fully understood in the following description with reference to accompanying drawings, in which.

DETAILED DESCRIPTION OF THE PREFERRED EMBODIMENT

Referring to FIGS. 1 to 5, a table horse racing according to the present invention comprises a table frame, a board a, a crank d, a crank shaft g, a nut h, an angle plate i, a rubber band, and hooks 1. The table frame has two opposite lateral walls and two opposite end walls and each of said two lateral walls at a top part thereof is provided with an inner elongated groove f respectively. The board e has two opposite lateral edges inserted in said groove f respectively so as to be mounted on the table frame. A plurality of artificial horses a are lined up along an end of the board. A plurality of bumps b are provided spaced apart to each other near the other end edge of the board for corresponding to these horses a. A crank d is associated with an end of a crank shaft g and the crank shaft g passes through one of said two lateral walls to be rotatably supported by the lateral walls of the table frame. A nut h provided on the crank shaft g and an angle plate i is fixedly attached to the bottom of the board to keep contact with the nut h. In addition, a room for board movement j is provided between an end wall of the table frame. An end of the board and the other end wall or the rear structure of the table frame and the bottom of the board are provided with a hook 1 respectively for mounting a rubber band k. The crank d can be turned clockwise or counterclockwise to operate the mechanism composed of the preceding elements.

Figure 1:
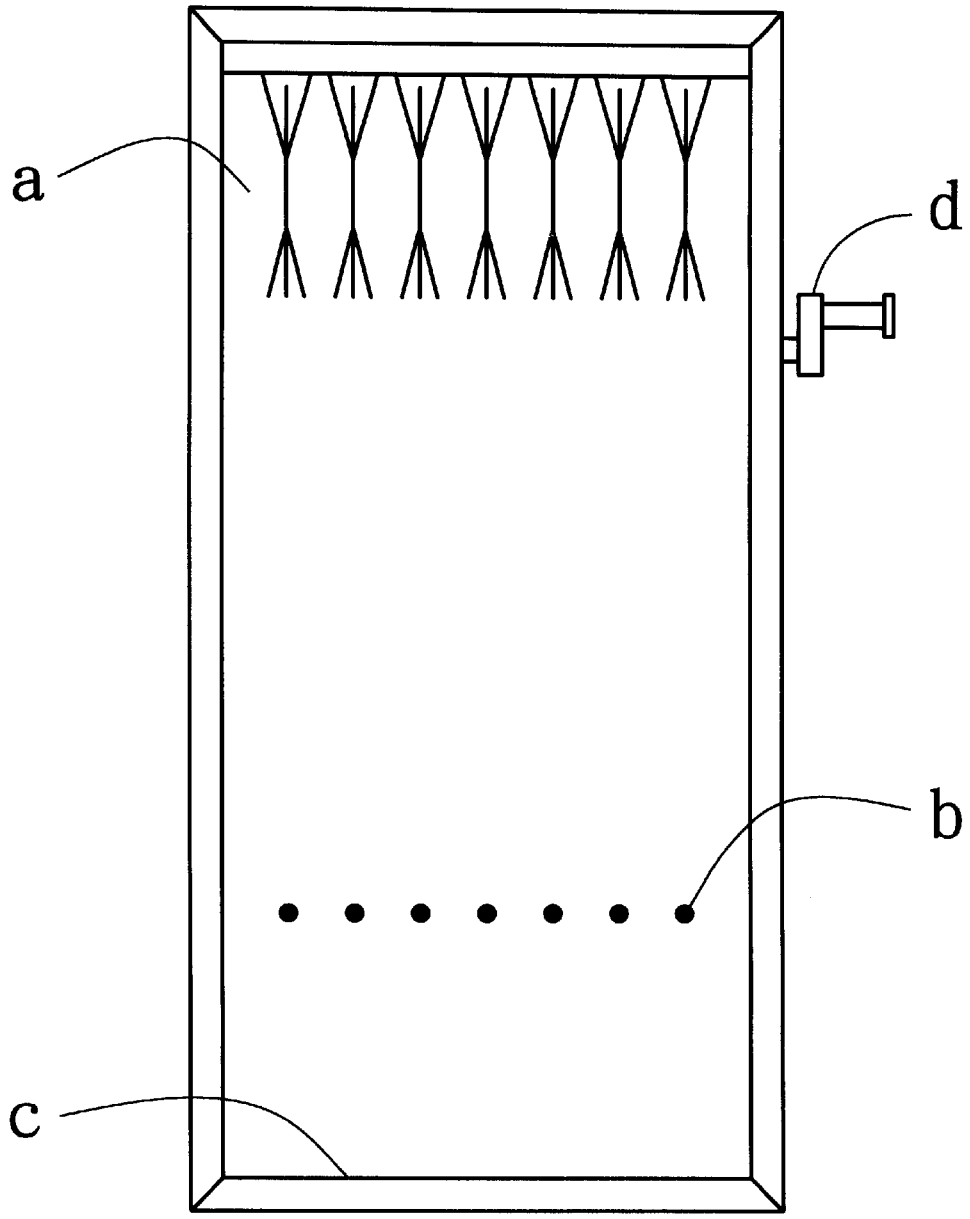
FIG. 1 is a top view of a table horse racing according to the present invention.
Figure 2:
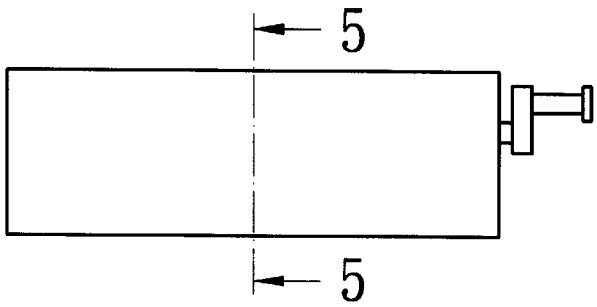
FIG. 2 is a front view of a table horse racing according to the present invention.
Figure 3:
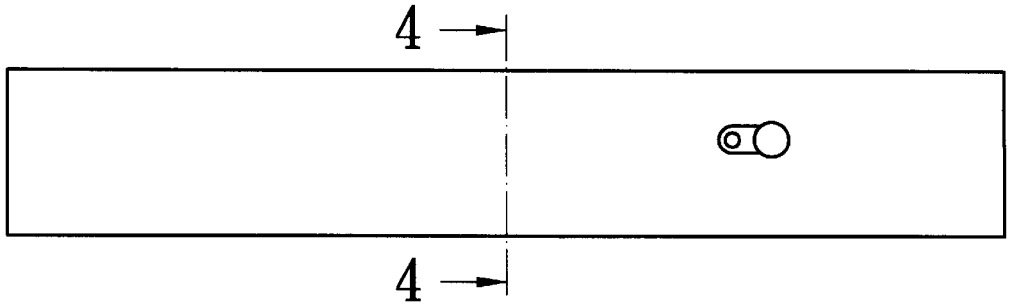
FIG. 3 is a side view of a table horse racing according to the present invention.
Figure 4:
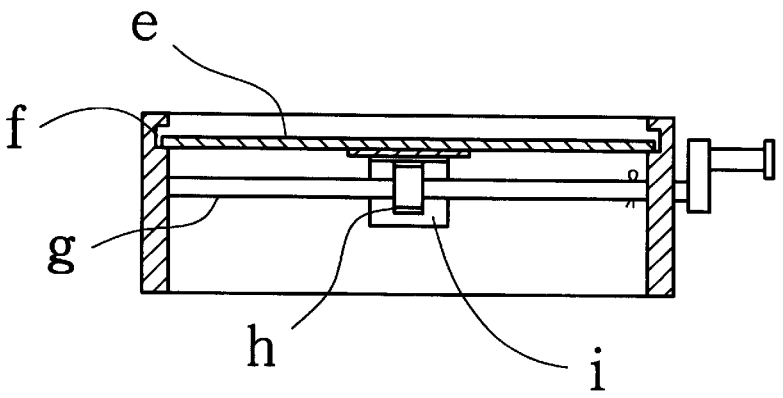
FIG. 4 is a sectional view along line 4—4 in FIG. 3.
Figure 5:
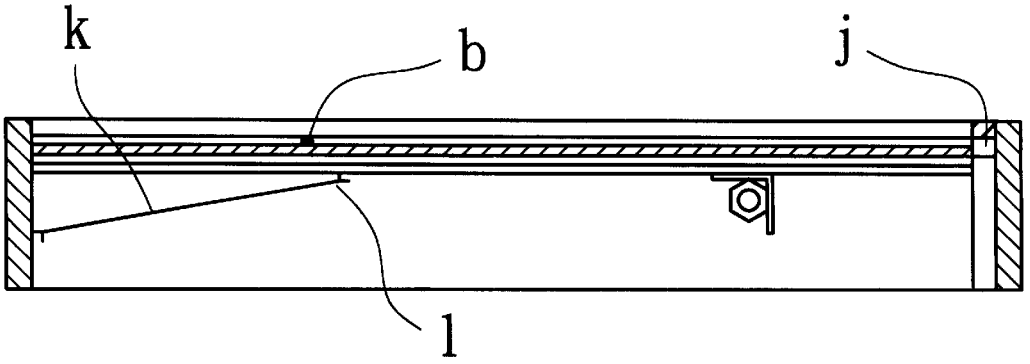
FIG. 5 is a sectional view along line 5—5 in FIG. 2.
Figure 6:
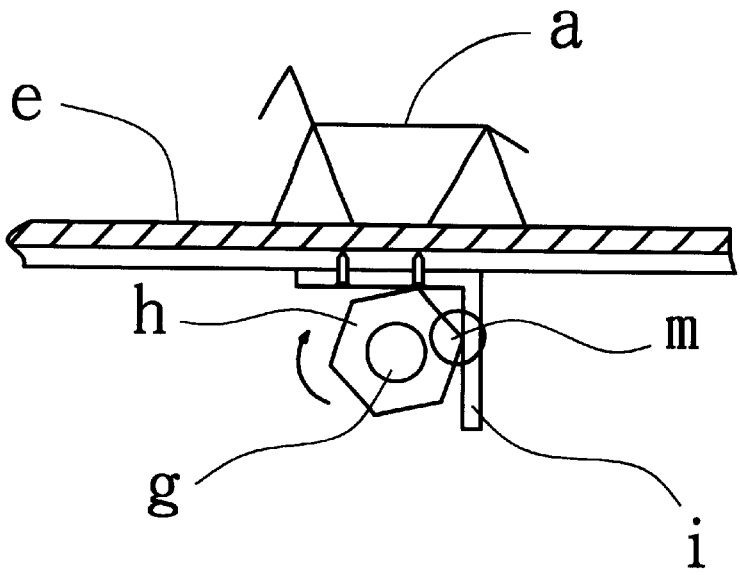
FIG. 6 is a fragmentary enlarged sectional view of FIG. 5.
Figure 7:
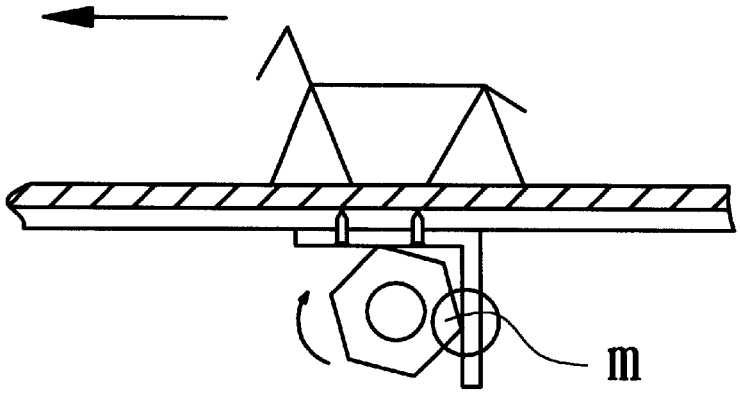
FIG. 7 is a fragmentary enlarged sectional view similar to FIG. 6.

Referring to FIGS. 6 and 7, the operation of the table horse racing according to the present invention will be explained hereinafter. The point x indicates one of the sharp corners on the nut h. As point x is turned clockwise against the angle plate i as shown in FIG. 6, and the point x may push the angle plate i forward so as to move the board e toward the room j. When the point x is turned further to a limit position, i.e., the board e with the angle plate i reaches its farthest distance in the room j, the board e is instantly pulled by the strength of the rubber band k backward. Thus, the board may cause a quick, back-and-forth shaking movement in the direction shown in FIG. 7 while the crank is turned continuously. In this way, the horses on the board may keep moving in one direction. In addition, the bumps b on the board increase the uncertainty about which horse reaches a finish line c (shown in FIG. 1) at the other end of the board e first. Thus, it makes this toy fun while playing.

While the invention has been described with reference to a preferred embodiment, it is to be understood that modifications and variations may be easily made without departing from the spirit of this invention defined by the appended claim.

What is claimed is:

1. A table horse racing for moving a plurality of simulated horses toward a finish line, comprising:

a table frame, having two opposite lateral walls and two opposite end walls, each of said two lateral walls at an upper part thereof being provided with an inner elongated groove respectively, and one of said end walls providing at least a first hook;

a board with two opposite lateral edges, two end edges, and a bottom, each of said two lateral edges being inserted in said groove respectively so as to mount on the table frame, a room between one of said two end edges and one of said end walls being left, providing a plurality of bumps spaced apart to each other near the other end edge, and at the bottom thereof being fixedly attached at least a second hook;

a crank associated with a crank shaft, the crank shaft passing through one of said two lateral walls and being rotatably supported by the table frame;

a nut, being provided on the crank shaft;

an angle plate, being fixedly attached to the bottom of the board, and keeping contact with the nut; and at least a rubber band, being engaged with the first and second hooks respectively;

whereby, the turning of the nut against the angle plate and the pulling action of the rubber band cause the board to shake back and forth so as to move the horses.

* * * * *